US011432996B2

(12) United States Patent
Weiming et al.

(10) Patent No.: US 11,432,996 B2
(45) Date of Patent: Sep. 6, 2022

(54) MOBILE EYE WASHING STATION

(71) Applicant: HONEYWELL INTERNATIONAL INC., Morris Plains, NJ (US)

(72) Inventors: Zhou Weiming, Morris Plains, NJ (US); Junyan Xu, Morris Plains, NJ (US); Lynette Li, Morris Plains, NJ (US); Rocky Qu, Morris Plains, NJ (US); Huaqing Liao, Morris Plains, NJ (US); Gary Cao, Morris Plains, NJ (US); Xue Liu, Morris Plains, NJ (US); Zhao Xia Jin, Morris Plains, NJ (US); David Hou, Morris Plains, NJ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 426 days.

(21) Appl. No.: 16/728,008

(22) Filed: Dec. 27, 2019

(65) Prior Publication Data

US 2020/0206076 A1 Jul. 2, 2020

(30) Foreign Application Priority Data

Dec. 29, 2018 (CN) ..... 201822250110.X

(51) Int. Cl.
*A61H 35/02* (2006.01)

(52) U.S. Cl.
CPC ..... *A61H 35/02* (2013.01); *A61H 2201/0107* (2013.01); *A61H 2201/0157* (2013.01); *A61H 2201/1238* (2013.01)

(58) Field of Classification Search
CPC ..... A61H 35/02; A61H 2201/0107; A61H 2201/0157; A61H 2201/1238; A47K 1/02
(Continued)

(56) References Cited

U.S. PATENT DOCUMENTS 5,566,406 A 10/1996 Demeny et al.
6,296,626 B1 * 10/2001 Stein ..... A61H 35/02 604/294

(Continued)

FOREIGN PATENT DOCUMENTS

CN 108309762 A 7/2018

OTHER PUBLICATIONS

Notice of Grant of Patent for Chinese Application No. 201822250110.X, dated Nov. 20, 2019, 4 pages.

(Continued)

*Primary Examiner* — Benjamin R Shaw
(74) *Attorney, Agent, or Firm* — Alston & Bird LLP

(57) ABSTRACT

Apparatuses are described that provide for a mobile eye washing station. An example station includes a fluid storage cartridge that stores unused eye wash fluid and a nozzle assembly in fluid communication with the fluid storage cartridge. In operation, the nozzle assembly dispenses the unused eye wash fluid stored in the fluid storage cartridge via one or more nozzles of the nozzle assembly. The example station further includes a waste fluid collection basin that, in operation, collects eye wash fluid dispersed by the nozzle assembly. Due to contact with the fluid storage cartridge, the waste fluid collection basin compresses the fluid storage cartridge to drive fluid communication between the fluid storage cartridge and the nozzle assembly. The fluid storage cartridge is disposed vertically beneath the waste fluid collection basin.

15 Claims, 6 Drawing Sheets

(58) Field of Classification Search
USPC ..... 4/625
See application file for complete search history.

(56) References Cited

U.S. PATENT DOCUMENTS

| | | | | |
|---|---|---|---|---|
| 2004/0244106 | A1* | 12/2004 | Chesters | A61H 35/00 4/620 |
| 2006/0260042 | A1* | 11/2006 | Eveleigh | A47K 3/286 4/620 |
| 2007/0089231 | A1* | 4/2007 | Smith | A61H 35/02 4/620 |
| 2007/0089234 | A1* | 4/2007 | Copeland | A61H 35/02 4/620 |
| 2008/0119799 | A1* | 5/2008 | Perrin | A61H 35/02 604/294 |
| 2008/0172787 | A1* | 7/2008 | Tao | A61H 35/02 368/10 |
| 2012/0330251 | A1* | 12/2012 | Boissonneault | F16K 31/22 604/296 |
| 2014/0025023 | A1* | 1/2014 | Boissonneault | A61H 33/6068 604/294 |

OTHER PUBLICATIONS

CA Office Action dated Dec. 14, 2021 for CA Application No. 3065981, 6 pages.

* cited by examiner

MOBILE EYE WASHING STATION

CROSS-REFERENCE TO RELATED APPLICATIONS

This specification is based upon and claims the benefit of priority from Chinese patent application number CN 201822250110.X filed on Dec. 29, 2018, the entire contents of which are incorporated herein by reference.

TECHNOLOGICAL FIELD

Example embodiments of the present invention relate generally to safety systems and, more particularly, to mobile eye washing stations.

BACKGROUND

Manufacturing facilities, chemical labs, and other related locations often handle materials that are harsh or otherwise dangerous to users. In many industries, these materials may cause substantial damage to a user's eyes and face as these areas are particularly sensitive to such materials. As such, emergency eye washing stations may be employed to provide relief from unintended contact with these harsh materials. Furthermore, many industries require the installation of emergency eye washing stations in order to comply with applicable industry regulations and standards.

BRIEF SUMMARY

Traditional apparatuses and devices used for emergency eye washing are often bulky and immobile. In order to support the weight of these traditional apparatuses, the eye washing stations are often required to be secured to walls or other support structures. As such, these traditional apparatuses fail to accommodate industries in which eye related dangers may be found in varying locations. Said differently, the locations of these traditional eye washing stations must be well known to employees in order to be readily used and may often be located in inopportune locations (e.g., too far from high-danger areas). Furthermore, these traditional stations may include large, top-heavy configurations that are too bulky to relocate and/or must be disassembled after a single use.

To solve these issues and others, example implementations of embodiments of the present invention may provide a mobile eye washing station that is easily relocatable within a facility and that provides intuitive operation to a user in emergency situations. An example mobile eye washing station of the present invention may include a fluid storage cartridge that may be configured to store unused eye wash fluid, and a nozzle assembly in fluid communication with the fluid storage cartridge. In operation, the nozzle assembly may be configured to disperse the unused eye wash fluid stored in the fluid storage cartridge via one or more nozzles. The station may further include a waste fluid collection basin, wherein, in operation, the waste fluid collection basin may be configured to collect eye wash fluid dispersed by the nozzle assembly. Via contact with the fluid storage cartridge, the waste fluid collection basin may compress the fluid storage cartridge to drive fluid communication between the fluid storage cartridge and the nozzle assembly.

In some embodiments, the fluid storage cartridge may be disposed vertically beneath the waste fluid collection basin such that, in operation, the weight of the eye wash fluid collected by the waste fluid collection basin compresses the fluid storage cartridge via direct contact. In such an embodiment, one or more fluid channels may extend from the fluid storage cartridge disposed vertically beneath the waste fluid collection basin and the nozzle assembly to provide fluid communication therebetween.

In some cases, the station may include one or more spring loaded assemblies configured to facilitate initial dispersion of the eye wash fluid.

In some other embodiments, the station may include a station head that supports the nozzle assembly and is disposed vertically above the waste fluid collection basin. In such an embodiment, the station head may be configured to be actuated by a user to cause dispersion of the unused eye wash fluid. In some further embodiments, the station head may be configured to be actuated via a user inputted, downward force opposite the direction of dispersion of the unused eye wash fluid.

In some embodiments, the station may include two spring loaded assemblies disposed vertically above the fluid storage cartridge. In such an embodiment, the two spring loaded assemblies may be configured to, in response to the user inputted downward force, compress the fluid storage cartridge so as to initially drive fluid communication between the fluid storage cartridge and the nozzle assembly.

In some cases, the nozzle assembly may include two nozzles each configured to disperse unused eye wash fluid to respective eyes of a user.

In some embodiments, the station may further include a housing enclosing the fluid storage cartridge and the waste fluid collection basin. The station may also further include a door configured to provide selective access to an interior of housing. In such an embodiment, the waste fluid collection basin and/or the fluid storage cartridge may be removable from the housing.

In any embodiment, the mobile eye wash station may further include a plurality of wheels configured to facilitate movement of the station.

The above summary is provided merely for purposes of summarizing some example embodiments to provide a basic understanding of some aspects of the invention. Accordingly, it will be appreciated that the above-described embodiments are merely examples and should not be construed to narrow the scope or spirit of the invention in any way. It will be appreciated that the scope of the invention encompasses many potential embodiments in addition to those here summarized, some of which will be further described below.

BRIEF DESCRIPTION OF THE DRAWINGS

Having described certain example embodiments of the present disclosure in general terms above, reference will now be made to the accompanying drawings. The components illustrated in the figures may or may not be present in certain embodiments described herein. Some embodiments may include fewer (or more) components than those shown in the figures.

DETAILED DESCRIPTION

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

Figure 1:
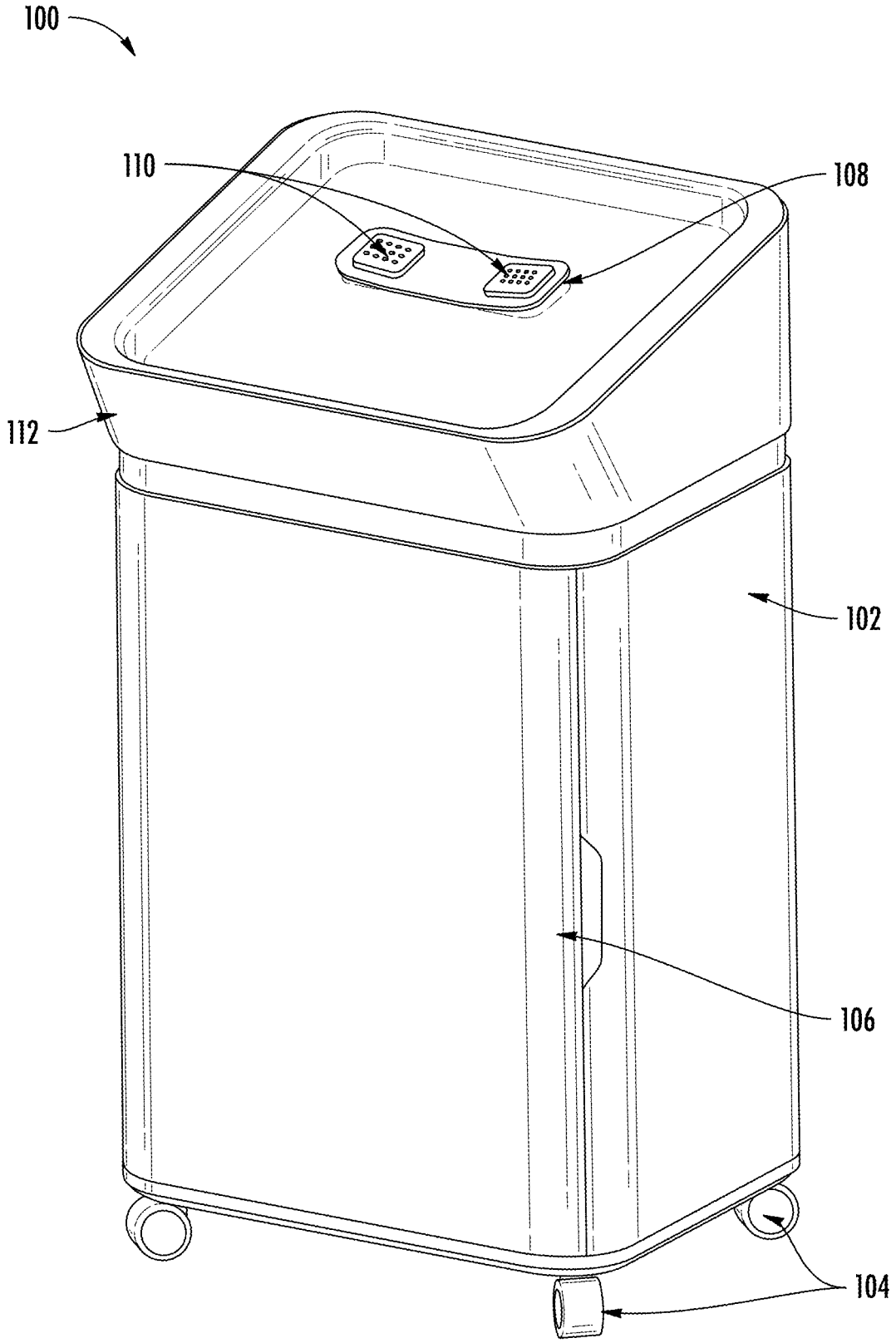
FIG. 1 is a perspective view of an eye washing station according to an example embodiment.
Figure 2:
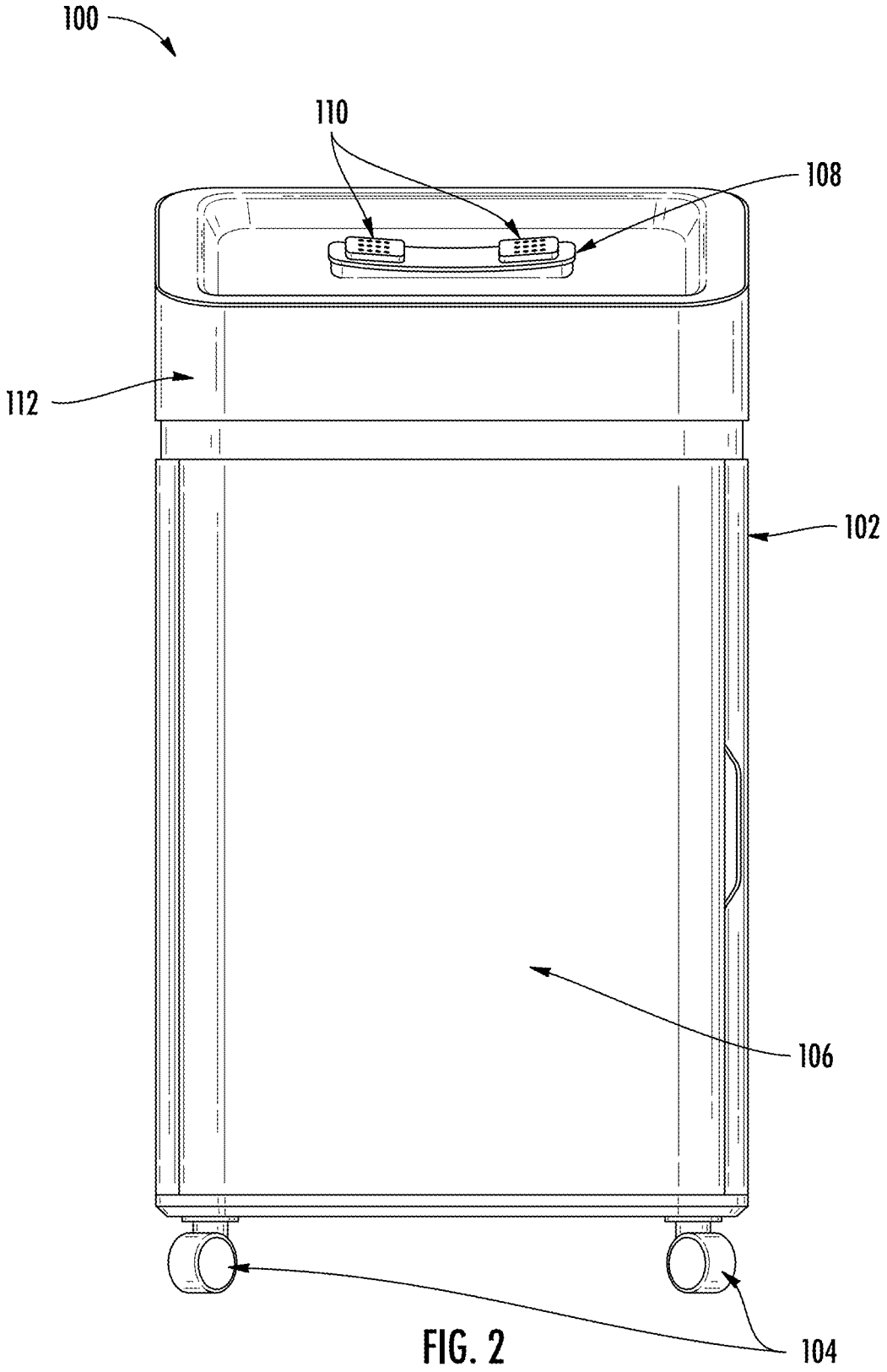
FIG. 2 is a front view of the eye washing station of FIG. 1 according to an example embodiment.
Figure 3:
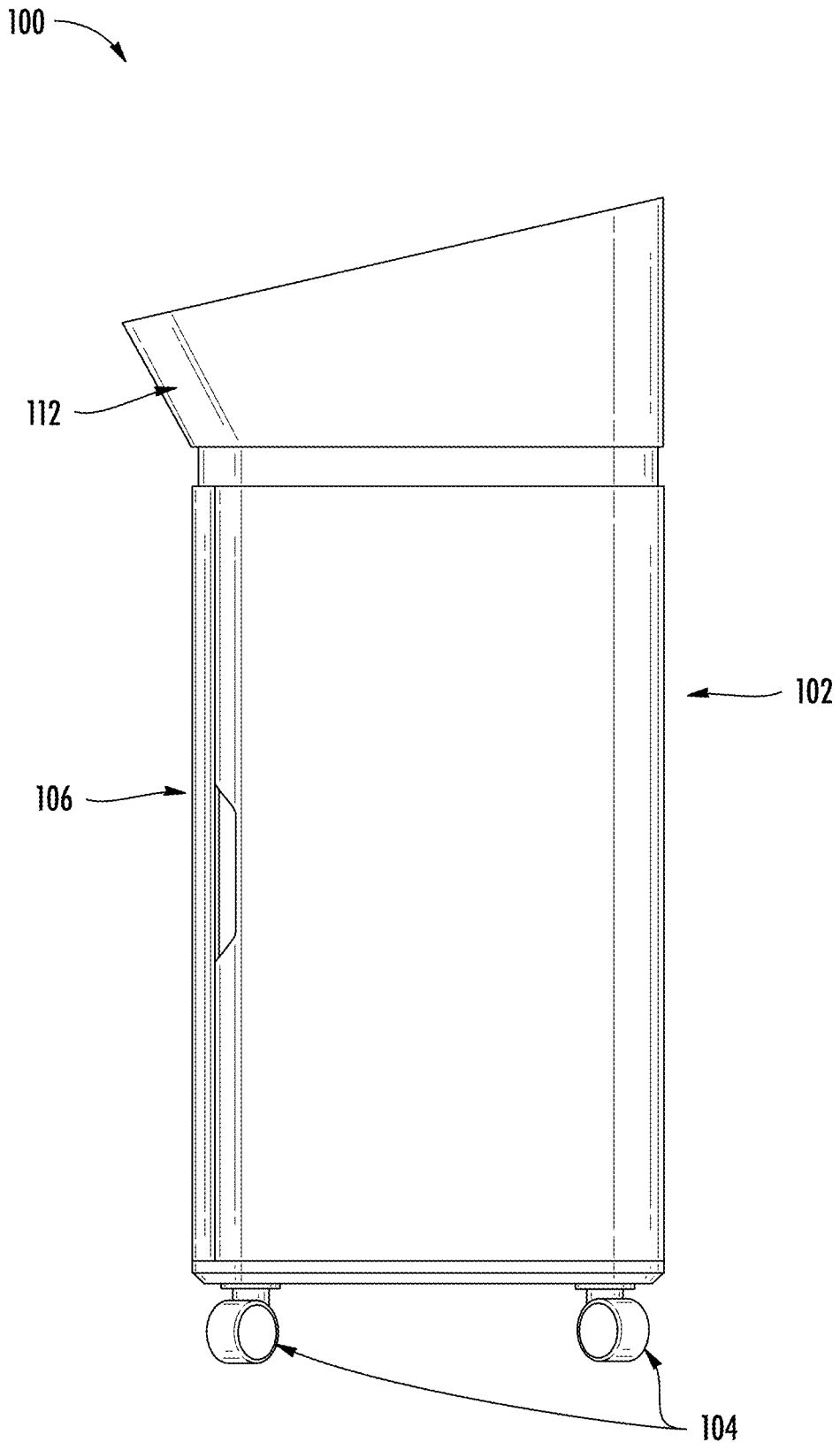
FIG. 3 is a side view of the eye washing station of FIG. 1 according to an example embodiment.

With reference to FIGS. 1-3, an example eye washing station 100 (e.g., station 100) is illustrated. As shown, the station 100 includes a housing 102, a nozzle assembly 108, a station head 112, and a plurality of wheels 104. The housing 102 may operate as an enclosure that supports or otherwise covers the internal elements of the station 100 described hereafter with reference to FIGS. 4 and 6A-6B. In the embodiment illustrated in FIGS. 1-3, the housing 102 may further define a door 106 that allows for selective access to the interior of the housing 102. Said differently, the door 106 may allow a user to remove or modify various elements supported within the housing 102. While illustrated and described herein with reference to a door 106, the present disclosure contemplates that any feature that allows access to the interior of the housing 102 (e.g., a sliding panel, a removable face, etc.) may be used. Similarly, while illustrated and describe herein with reference to a housing 102 shaped as a substantially hollow rectangular prism, the present disclosure contemplates that the housing 102 may be dimensioned (e.g., sized and shaped) based upon the intended application.

With continued reference to FIGS. 1-3, the station 100 may further include a nozzle assembly 108 that defines one or more nozzles 110 for dispersing eye wash fluid as described hereafter. As would be evident to one of ordinary skill in the art in light of the present disclosure, during operation, the nozzles 110 of the nozzle assembly 108 may be configured to project or otherwise force water into a user's eyes to remove harmful materials, particulate matter, or the like. As such, in some embodiments, the nozzle assembly 108 may define two (2) nozzles 110 each configured for dispersing eye wash fluid to a respective eye of a user. While illustrated and described herein with reference to two (2) nozzles, the present disclosure further contemplates that the nozzle assembly 108 may include any number of nozzles 110 at any position or orientation. Furthermore, the present disclosure contemplates that the nozzle assembly 108 may define any element for dispersing eye wash fluid (e.g., jet, spout, or other fluid projection element).

As shown in FIGS. 1-3 and described more fully hereafter with reference to FIGS. 5A-6B, the eye washing station 100 (e.g., station 100) may define a station head 112 that supports the nozzle assembly 108. As shown, the station head 112 may be positioned at the top most portion of the hosing 102. The station head 112 may be configured to translate into at least a portion of the housing 102 so as to compress various elements described hereafter. Said differently, a user may actuate the station head 112 (e.g., press down on the station head 112) so as to cause dispersion of the eye wash fluid (e.g., unused eye wash fluid stored by the fluid storage cartridge 114 described hereafter) from the nozzles 110 of the nozzle assembly 108. As above, the station head 112 may be dimensioned (e.g., sized and shaped) to correspond to the dimensions of the housing 102 and/or may be based on the intended application of the station 100.

As described above, the station 100 may be configured as a mobile eye washing station 100 such that the station 100 may be positioned at any location in a facility. Said differently, the station 100 does not require attachment (e.g., temporary or permanent) to an existing structure such as a wall, another machine, or the like. As such, the station 100 may be moved from location to location within a facility without modification to the station 100. Unlike traditional devices that are often affixed to a wall to support the weight of the device, in some embodiments, the station 100 may define a plurality of wheels 104 to facilitate movement of the station. As shown, the wheels 104 may be located on a bottom surface of the housing 102 (e.g., opposite the station head 112 and nozzle assembly 108). While illustrated and described herein with reference to a plurality of wheels 104, the present disclosure contemplates that any number of wheels at any position or orientation as well as other elements (e.g., rollers, casters, or the like) may be used to facilitate mobility of the station 100.

Figure 4:
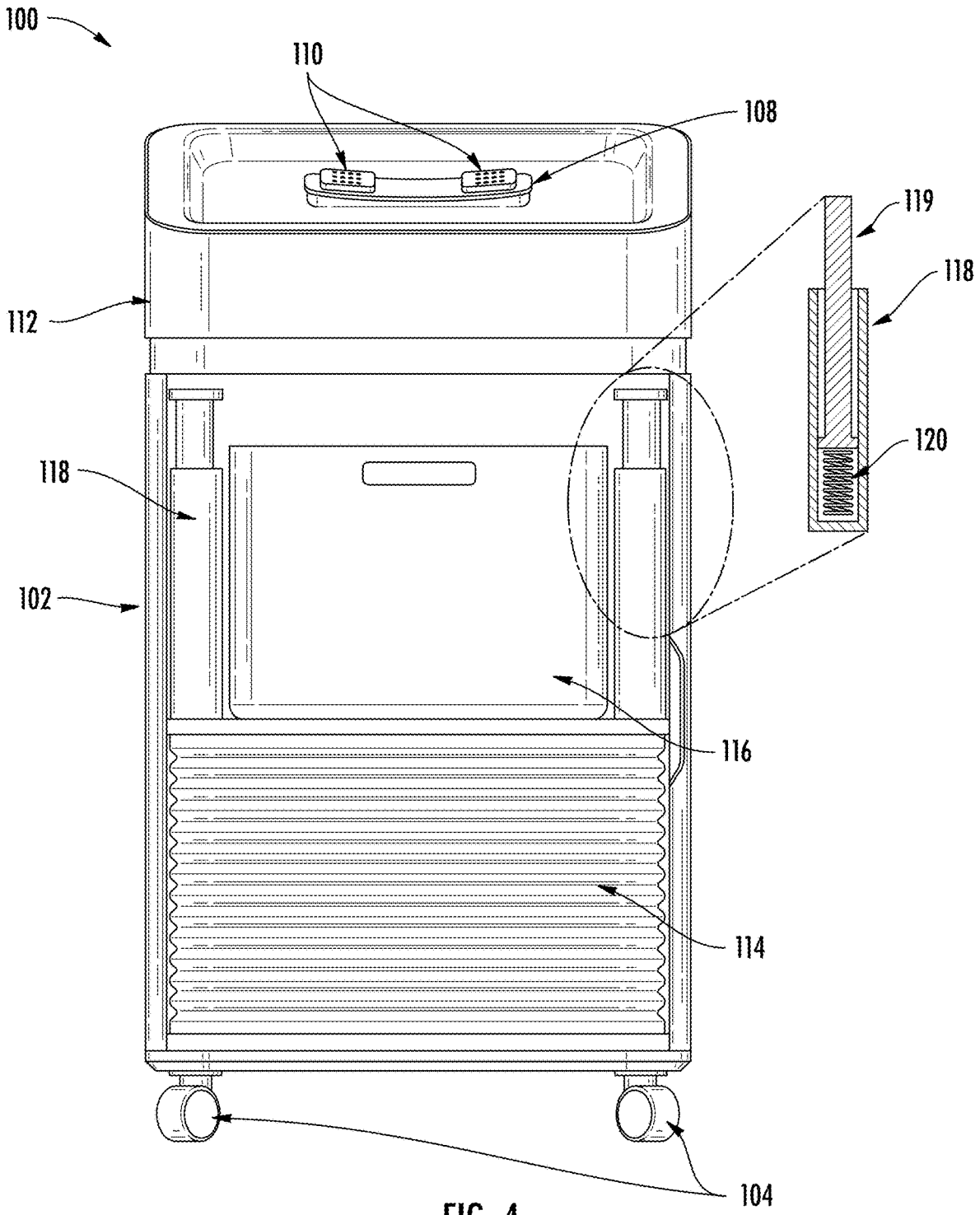
FIG. 4 is a front open view of an example eye washing station illustrating internal elements according to an example embodiment.

With reference to FIG. 4, a front open view of an example eye washing station 100 illustrating internal elements is shown. As shown, the station 100 may include a fluid storage cartridge 114 (e.g. cartridge 114), a waste fluid collection basin 116 (e.g., basin 116), and one or more spring loaded assemblies 118 enclosed by the housing 102. The cartridge 114 may be configured to store unused eye wash fluid that may, during operation, be dispersed via the nozzles 110 of the nozzle assembly 108. As would be evident to one of ordinary skill in the art in light of the present disclosure, the cartridge 114 may store sterile fluid (e.g., water or the like) that may be safe for projecting into the face and eyes of a user. In some embodiments, the cartridge 114 may store other eye washing compounds, solutions, or the like that facilitate removable of hazardous materials, particulate matter, etc. from the eyes or face of a user. As would be evident to one of ordinary skill in the art in light of the present disclosure, the nozzle assembly 108, in order to disperse the unused eye wash fluid, must be in fluid communication with the cartridge 114. As illustrated hereafter with reference to FIGS. 6A-6B, the station 100 may include one or more fluid channels (e.g. channel 122) that extend from the cartridge 114 to the nozzle assembly 108 to provide fluid communication therebetween.

Figure 6B:
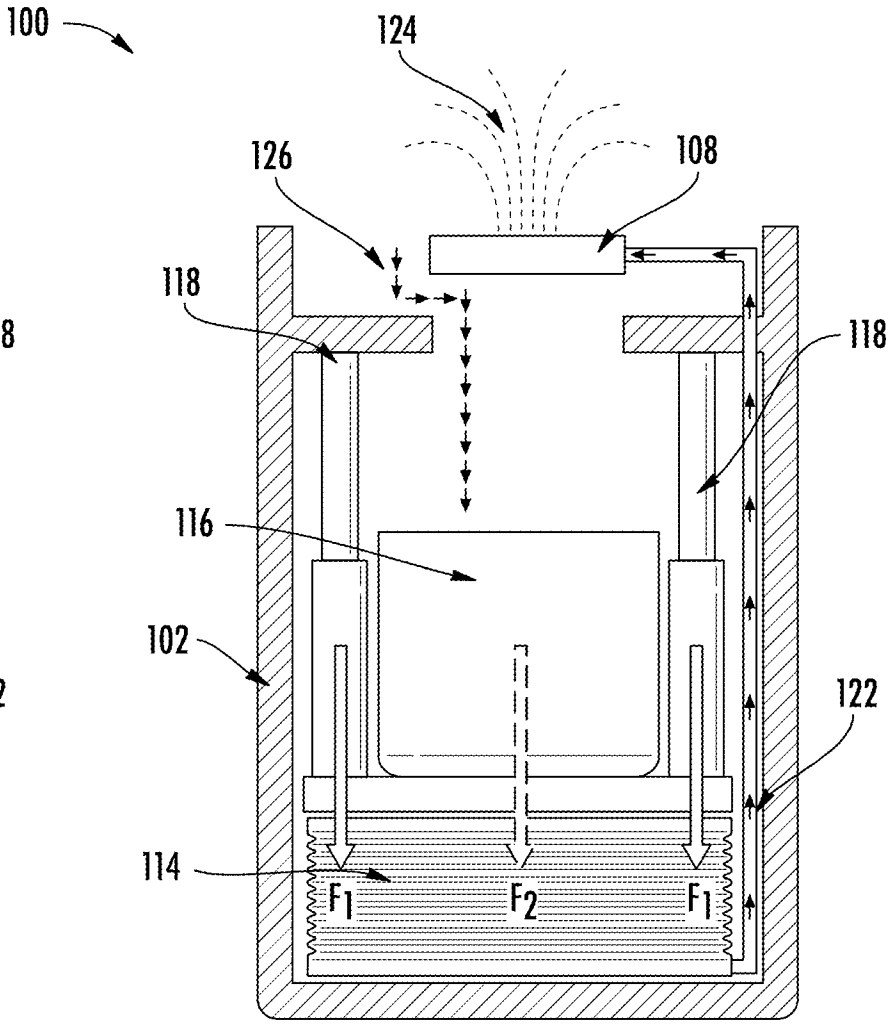
FIGS. 6A-6B are internal views of operation of an example eye washing station according to an example embodiment.
Figure 6A:
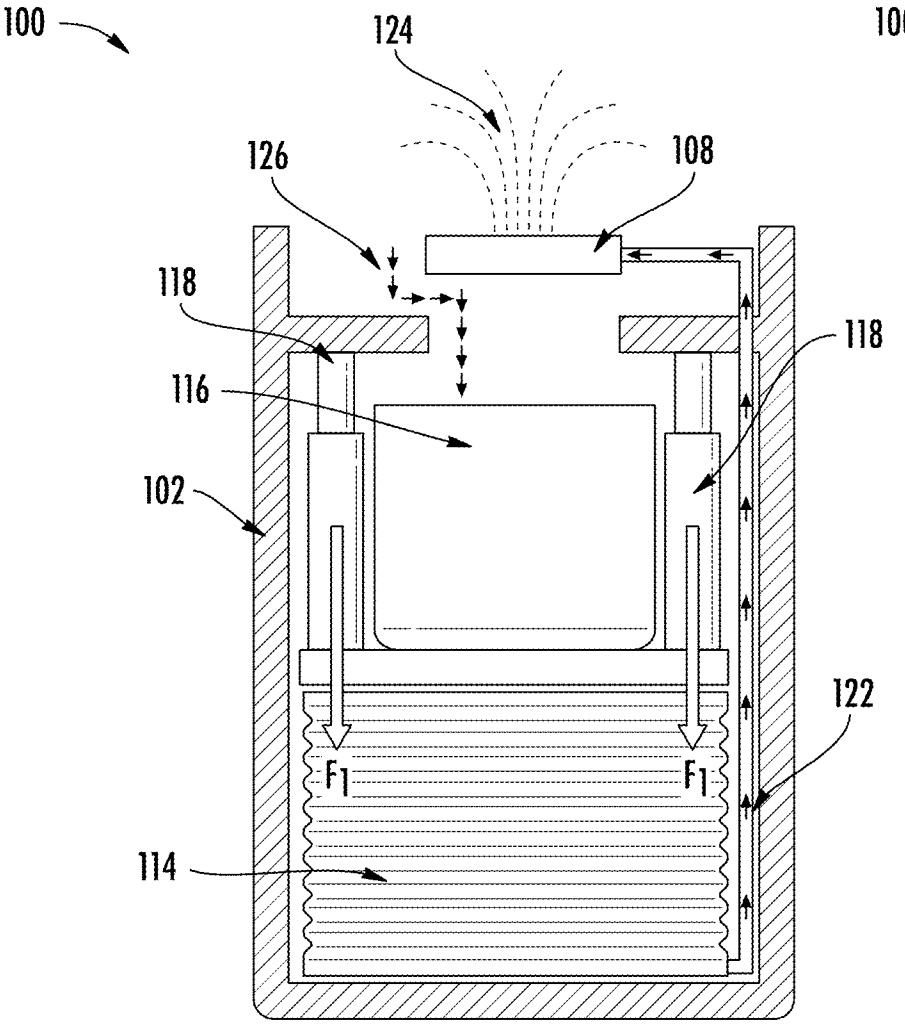

With continued reference to FIG. 4, the waste fluid collection basin (e.g. basin 116) may be configured to collect eye wash fluid dispersed by the nozzle assembly 110 during operation of the station 100 (illustrated in FIGS. 6A-6B hereafter). As shown, the basin 116 and cartridge 114 may be positioned such that the cartridge 114 is disposed vertically beneath the basin 116 such that the weight of the eye wash fluid collected by the basin 116 compresses the cartridge 114 via direct contact. This compression may drive fluid communication between the cartridge 114 and the nozzle assembly 108 (e.g., compressing the eye wash fluid in the cartridge 114 such that the fluid is propelled via the one or more fluid channels described hereafter).

The station 100 may further include one or more spring loaded assemblies 118 that may be configured to facilitate the initial dispersion of unused eye wash fluid. As shown, in some embodiments, the station 100 may include two (2) spring loaded assemblies 118 disposed vertically above the fluid storage cartridge 114 (e.g., cartridge 114), and adjacent the waste fluid collection basin 116 (e.g., basin 116). The spring loaded assemblies 118 may further define a piston 119 and a spring 120 that are configured to transmit force input from a user so as to compress the cartridge 114.

Figure 5B:
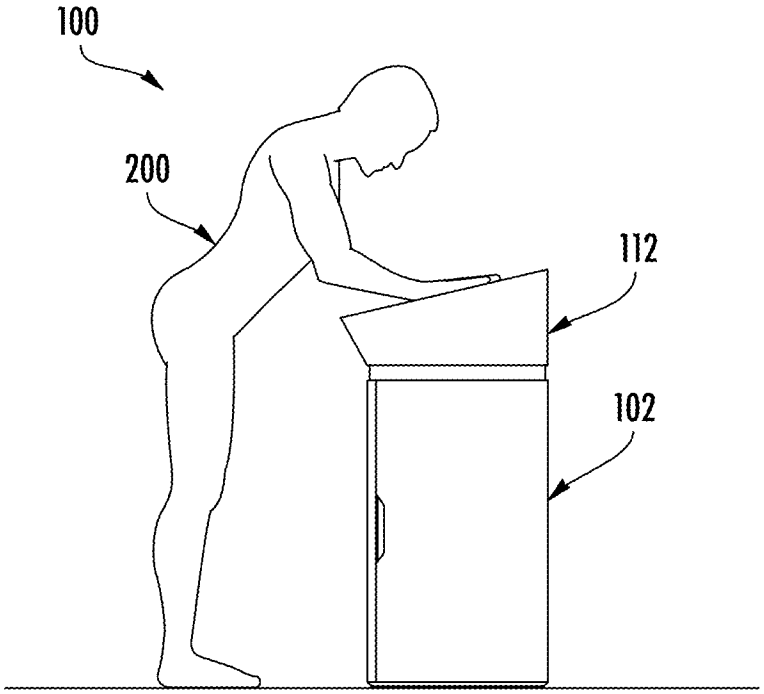
FIGS. 5A-5B are external views of initiating operation of an example eye washing station according to an example embodiment.
Figure 5A:
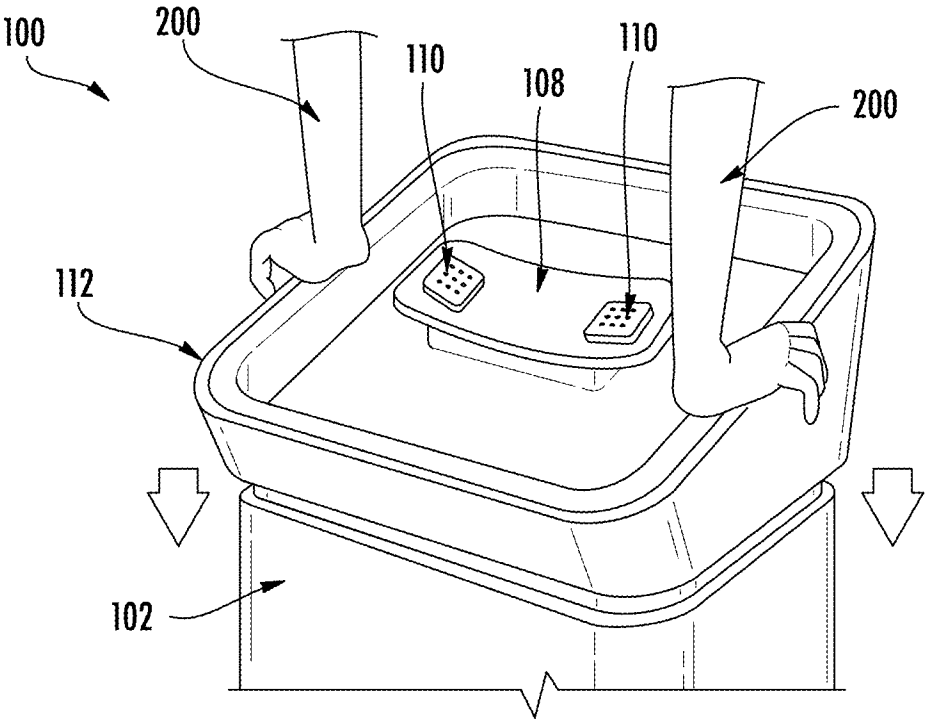

With reference to FIGS. 4-5B, during operation, a user 200 may input a downward force (e.g., opposite the direct of the dispersion of unused eye wash fluid) to the station head 112 such that the station head 112 translates at least partially within the housing 102. This translation drives the pistons 119 of the spring loaded assemblies 118 down so as to compress the springs 120. This downward force by the user 200 of FIGS. 5A-5B is transferred by the spring loaded assemblies 118 to compress the cartridge 114 and transmit unused eye wash fluid stored in the cartridge to the nozzle assembly 110 (via the fluid channel 112 of FIGS. 6A-6B). As would be evident to one of ordinary skill in the art in light of the present disclosure, prior to operation, the basin 116 may be empty (e.g., no eye wash fluid located therein) such that the basin 116 lacks sufficient force (e.g., weight) to compress the cartridge 114 to such a degree that fluid is transmitted from the cartridge 114 to the nozzle assembly 108. This weight distribution may be desirable to prevent the station 100 from dispersing unused eye wash fluid from the nozzle assembly 108 without a user 200 input (e.g., prior to intended use).

With reference to FIGS. 6A and 6B, an initial operation of the station 100 and filling of the basin 116 are illustrated, respectively. As shown in FIG. 6A, a user inputted force (such as shown in FIGS. 5A-5B) initially compresses the spring loaded assemblies 118 such that a force $F_1$ is imparted on the cartridge 114 by each of the spring loaded assemblies 118. The force $F_1$ of each assembly 118 compresses the cartridge 114 and drives unused eye wash fluid stored in the cartridge 114 into the fluid channel 122. As shown, the fluid channel 122 may extend from the cartridge 114 located vertically beneath the basin 116 to the nozzle assembly 108 such that the eye wash fluid 124 may be dispersed by the nozzle assembly 108. While illustrated and described herein with reference to a single fluid channel 122 on one side of the housing 102, the present disclosure contemplates that any number of fluid channels at any position or orientation may be used to provide fluid communication.

With continued reference to FIGS. 6A and 6B, some of the dispersed eye wash fluid 124 may contact the user (e.g., eyes, face, etc.) and not return to the station 100. As illustrated in FIGS. 6A-6B, however, used eye wash fluid 126 may be collected by the basin 116. As shown in FIG. 6B, as increased used eye wash fluid 126 is collected by the basin 116, the force $F_2$ exhibited by the basin 116 (e.g., the increased weight) is sufficient to compress the cartridge 114. As would be evident to one of ordinary skill in the art in light of the present disclosure, as the used eye wash fluid 126 collects in the basin 116 the force $F_1$ exhibited by the spring loaded assemblies 118 decreases relative the force exhibited by the basin 116 $F_2$. Following transmission of substantially all of the unused eye wash stored by the cartridge 114, operation may cease such that dispersion of the eye wash fluid 124 may halt. Following operation, one or more of the basin 116 and the cartridge 114 may be removed from the station 100 (e.g., to remove used eye wash fluid or reload/replace the unused eye wash fluid).

As shown, the eye washing station 100 of the present invention may be configured such that the basin 116 and the cartridge 114 are vertically aligned. In particular, the cartridge 114 may be located vertically beneath the basin 116 such that the basin 116 may compress the cartridge 114 through direct contact. As would be evident to one of ordinary skill in the art in light of the present disclosure, this positioning operates to reduce the overall size of the station 100 while also providing improved compression of the cartridge 114 (e.g., via direct contact). As described above, this smaller overall size allows for improved mobility of the eye washing station 100 in that additional overhead weight is not required to be secured to a supporting structure. Furthermore, the use of spring loaded assemblies to initially drive fluid transmission allows for a controlled, continuous flow of eye wash fluid.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A mobile eye washing station comprising:

a fluid storage cartridge, wherein the fluid storage cartridge is configured to store unused eye wash fluid;

a nozzle assembly in fluid communication with the fluid storage cartridge, wherein, in operation, the nozzle assembly is configured to disperse the unused eye wash fluid stored in the fluid storage cartridge via one or more nozzles; and a waste fluid collection basin, wherein, in operation, the waste fluid collection basin is configured to collect eye wash fluid dispersed by the nozzle assembly and, via contact with the fluid storage cartridge, compress the fluid storage cartridge to drive fluid communication between the fluid storage cartridge and the nozzle assembly.

2. The mobile eye washing station according to claim 1, wherein the fluid storage cartridge is disposed vertically beneath the waste fluid collection basin such that, in operation, the weight of the eye wash fluid collected by the waste fluid collection basin compresses the fluid storage cartridge via direct contact.

3. The mobile eye washing station according to claim 2, further comprising one or more fluid channels extending from the fluid storage cartridge disposed vertically beneath the waste fluid collection basin and the nozzle assembly to provide fluid communication therebetween.

4. The mobile eye washing station according to claim 1, further comprising one or more spring loaded assemblies configured to facilitate initial dispersion of the eye wash fluid.

5. The mobile eye washing station according to claim 1, further comprising a station head supporting the nozzle assembly and disposed vertically above the waste fluid collection basin.

6. The mobile eye washing station according to claim 4, wherein the station head is configured to be actuated by a user to cause dispersion of the unused eye wash fluid.

7. The mobile eye washing station according to claim 5, wherein the station head is configured to be actuated via a user inputted, downward force opposite the direction of dispersion of the unused eye wash fluid.

8. The mobile eye washing station according to claim 7, further comprising two spring loaded assemblies disposed vertically above the fluid storage cartridge.

9. The mobile eye washing station according to claim 8, wherein the two spring loaded assemblies are configured to, in response to the user inputted downward force, compress the fluid storage cartridge so as to initially drive fluid communication between the fluid storage cartridge and the nozzle assembly.

10. The mobile eye washing station according to claim 1, wherein the nozzle assembly comprises two nozzles each configured to disperse unused eye wash fluid to respective eyes of a user.

11. The mobile eye washing station according to claim 1, wherein the station further comprises a housing enclosing the fluid storage cartridge and the waste fluid collection basin.

12. The mobile eye washing station according to claim 11, further comprising a door configured to provide selective access to an interior of housing.

13. The mobile eye washing station according to claim 11, wherein the waste fluid collection basin is removable from the housing.

14. The mobile eye washing station according to claim 11, wherein the fluid storage cartridge is removable from the housing.

15. The mobile eye washing station according to claim 1, further comprising a plurality of wheels configured to facilitate movement of the station.

* * * * *